US006826789B1

(12) United States Patent
Choi

(10) Patent No.: US 6,826,789 B1
(45) Date of Patent: Dec. 7, 2004

(54) SOFA EQUIPPED WITH RADIANT HEATING MATTRESS FOR FOMENTATION AND MASSAGE

(75) Inventor: Chang-Hwan Choi, 490-4, Neungpyeong-ri, Chpo-eup, Gwangjoo city, Gyeonggi-do, 464-892 (KR)

(73) Assignees: Chang-Hwan Choi, Gwangjoo (KR); Jang Soo Industrial Co., Ltd., Seoul (KR)

( * ) Notice: Subject to any disclaimer, the term of this patent is extended or adjusted under 35 U.S.C. 154(b) by 0 days.

(21) Appl. No.: 10/694,187

(22) Filed: Oct. 28, 2003

(30) Foreign Application Priority Data

Jul. 8, 2003 (KR) ..... 10-2003-0021938
Aug. 28, 2003 (KR) ..... 20-2003-0059969

(51) Int. Cl.[7] ..... A47C 17/00; A47C 21/04
(52) U.S. Cl. ..... 5/12.1; 5/421
(58) Field of Search ..... 5/12.1, 51.1, 2.1, 5/421, 284

(56) References Cited

U.S. PATENT DOCUMENTS 1,248,702 A * 12/1917 Percival ..... 5/15
2,582,555 A * 1/1952 Miller ..... 5/48
3,186,758 A * 6/1965 Wanzenried ..... 297/118
5,146,633 A * 9/1992 Kim et al. ..... 5/421
5,241,959 A * 9/1993 Kim et al. ..... 607/104
5,259,379 A * 11/1993 Kim et al. ..... 607/104
5,430,900 A * 7/1995 Kim ..... 5/421
5,444,878 A * 8/1995 Kang ..... 5/421
5,550,007 A * 8/1996 Taylor et al. ..... 430/314
5,740,564 A * 4/1998 Hankins et al. ..... 5/12.1
5,889,923 A * 3/1999 Lee et al. ..... 392/435
6,148,457 A * 11/2000 Sul ..... 5/421
2004/0034930 A1 * 2/2004 Cho ..... 5/421

FOREIGN PATENT DOCUMENTS

CH 264248 * 1/1950 ..... 5/12.1
DE 2103258 * 8/1972 ..... A47C/17/14
DE 2916110 A1 * 10/1980 ..... A47G/9/02
DE 3333707 A1 * 8/1984 ..... A47C/27/14
DE 3707948 A1 * 9/1988 ..... A61G/1/00

* cited by examiner

*Primary Examiner*—Robert G. Santos
(74) *Attorney, Agent, or Firm*—Birch, Stewart, Kolasch & Birch, LLP

(57) ABSTRACT

A sofa equipped with a radiant heating mattress for fomentation and/or massage, wherein a bed part equipped with the radiant heating mattress and a heating system internally built therein is mounted on one side of a seat part of the sofa, thereby allowing a user to rest comfortably and to enjoy fomentation and health massages by anions and far infrared rays from the radiant heating mattress of the bed part, with the use of sofa. The sofa has the seat part, a back part, an arm part and a frame, wherein one side of the seat part constitutes the bed part which is formed of a flat board having a wide area and is equipped with the radiant heating mattress produced with a board made of jade, gold-coated board, stone, mixture of yellow earth and hardwood charcoals, or ceramics so as to emit anions and far infrared rays. The sofa also allows a user to rest more stably and conveniently while watching TV or resting on the sofa, and also allows the user to take hot fomentation because the sofa is heated by the heating system. Simultaneously, the sofa is available for massages by anions and far infrared rays emitted from jade, gold-coated board, stone, mixture of yellow earth and hardwood charcoals or ceramics of the radiant heating mattress.

5 Claims, 4 Drawing Sheets

SOFA EQUIPPED WITH RADIANT HEATING MATTRESS FOR FOMENTATION AND MASSAGE

BACKGROUND OF THE INVENTION

1. Field of the Invention

The present invention relates, in general, to a sofa equipped with a radiant heating mattress for fomentation and/or massage and, more particularly, to a sofa equipped with a radiant heating mattress for fomentation and/or massage, wherein a bed part equipped with the radiant heating mattress and a heating system internally built therein is mounted on one side of a seat part of the sofa, thereby allowing a user to rest on the sofa comfortably and to enjoy fomentation and health massage by anions and far infrared rays from the radiant heating mattress of the bed part.

2. Description of the Prior Art

As well known to those skilled in the art, a sofa is usually positioned in a living room of a house, and a user uses the sofa to rest in a comfortable and convenient manner. The sofa comprises a seat part on which the user sits, a back part on which the user leans against, arm parts, a frame and leg parts.

For elegant appearances and agreeable touch, a cover or sheet is used to cover the back part and/or the seat part. The cover is usually made of synthetic fiber, leather artificial or natural, and the like.

According to the number of seat parts on which users sit, the sofa is classified by size into 1-person, 2-person, 3-person, 4-person and 5-person sofas. The sofa has a variety of forms to represent different tastes and beautiful representations thereof.

However, the sofa has usually been used as a means for providing the user with a space to rest conveniently. That is, a user watches TV or rests while sitting on the seat part of the sofa and leaning back on the back part. Except for them, the sofa has no additional functions. The sofa is thus comparatively costly and has poor utility. In this respect, the sofa cannot satisfy the consumer who wants to use it with multiple purposes.

Further, a user has to take a posture of sitting on the sofa to rest thereon. This posture eventually leads discomfort in the user's back or spine if he/she is sitting on the sofa for a long period of time, thereby causing an inconvenience to the user. If the user lays his/her back on the sofa to take a more comfortable rest, he/she has to bend because there is no sufficient space to lie down thereon. Therefore, the user cannot make natural movements or take stable postures, causing the user to be unstable and unsafe. Further, the user may get hurt if he/she falls off the sofa due to carelessness.

SUMMARY OF THE INVENTION

Accordingly, the present invention has been made keeping in mind the above problems occurring in the prior art, and an object of the present invention is to provide a sofa used for resting, wherein the user can rest with a more comfortable and convenient posture, by making a seat part on which the user sits to be a board having comparatively a wide area, and hot fomentation is available because the sofa can be heated by a heating system therein.

Another object of the present invention is to provide a sofa equipped with a radiant heating mattress for new forms of fomentation and/or massage, which a massage is applied for health promotion is given, by emitting anions and far infrared rays due to jade, gold-coated board, stone, mixture of yellow earth and hardwood charcoals or ceramics, etc.

In order to accomplish the above objects, the present invention provides a sofa comprising a seat part, a back part, an arm part and a frame, wherein one side of the seat part constitutes a bed part which is formed of a flat board having a wide area and is equipped with a radiant heating mattress for fomentation and/or massage, the radiant heating mattress being produced with a board made of jade, gold-coated board, stone, mixture of yellow earth and hardwood charcoals, or ceramics so as to emit anions and far infrared rays.

The radiant heating mattress is heated by a heating system, and an insulator and a copper plate are laid under the radiant heating mattress.

The heating system comprises a heating wire capable of being heated under the control of a controller, a bimetal and a temperature sensor, and the temperature of the heating wire is controlled by the controller.

Further, a cushion layer is formed on the surface of the radiant heating mattress of the bed part by a cushion member.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

A preferred embodiment of the present invention will be described in details with reference to the accompanying drawings.

Figure 1:
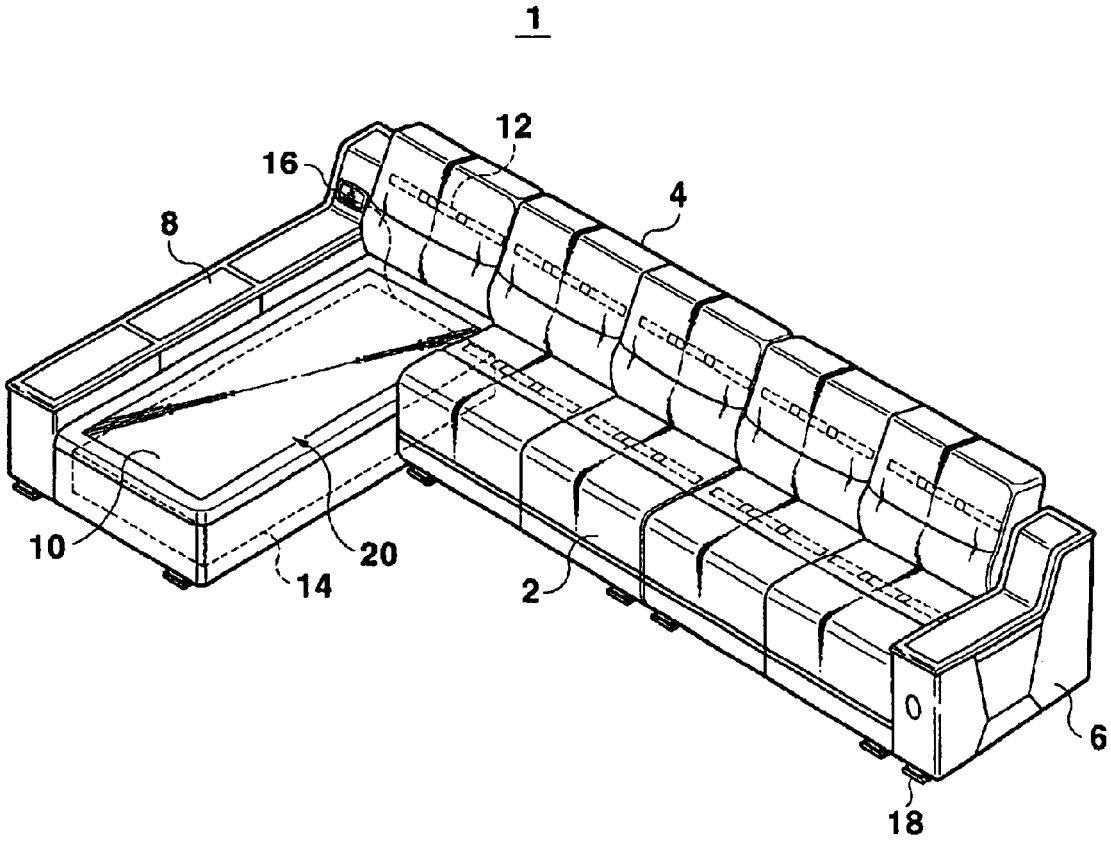
FIG. 1 is a perspective view of a sofa according to the present invention.
Figure 2:
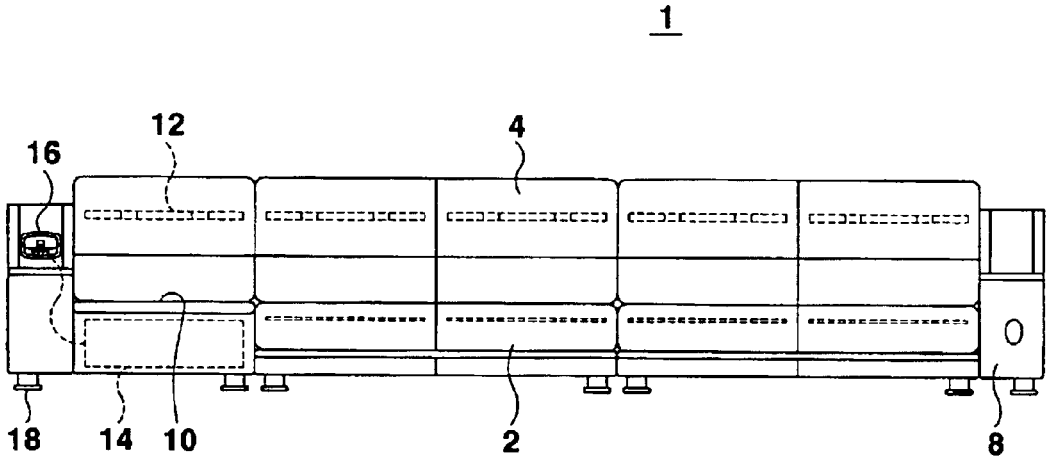
FIG. 2 is a front elevational view of the sofa according to the present invention.
Figure 3:
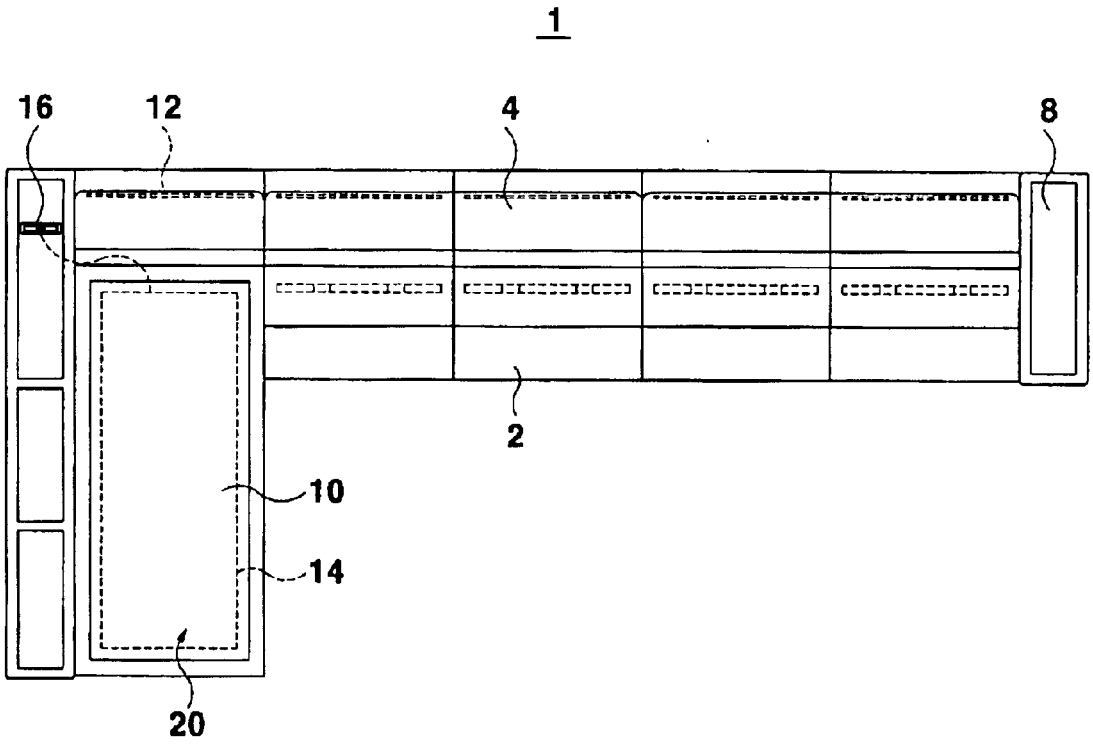
FIG. 3 is a top plan view of the sofa according to the present invention.

Referring to FIGS. 1 through 3, a sofa 1 according to a first embodiment of the present invention comprises a seat part 2, a back part 4, an arm part 6 and a frame 8. A bed part 20 equipped with a board-type radiant heating mattress 10 wider than the other parts of the sofa 1 is formed on a predetermined area of the sofa 1.

The board-type radiant heating mattress 10 is made of jade, gold-coated board, stone, mixture of yellow earth and hardwood charcoals, or ceramics, all of which can emit anions and far infrared rays.

FIG. 1 is a perspective view of the sofa 1 according to the first embodiment of the present invention, and FIG. 2 is a front elevational view of the sofa 1 of FIG. 1. As shown in FIGS. 1 and 2, a cushion member (sponge, etc.) is built in the frame 8 made of wood, and a cover made of leather covers both the seat part 2 and the back part 4, with a fastening means 12, e.g., a Velcro fastener, provided to detachably attach the seat part 2 and the back part 4 to the frame 8. One side of the frame 8 is extended to a predetermined length, on which the board-type radiant heating mattress 10 comprising jade, goldcoated board, stone, mixture of yellow earth and hardwood charcoals or ceramics is installed.

On the frame 8, a controller 16 is connected electrically to the radiant heating mattress 10. Therefore, the radiant heating mattress 10 is heated to a proper degree under the control of the controller 16. Under the corners of the frame 8 are installed a plurality of legs 18 to support the sofa 1.

FIG. 3 is a top plan view of the sofa 1 according to the first embodiment of the present invention, showing that a plurality of seat parts 2 and back parts 4 are mounted along the seat and the back of the frame 8, respectively. One side of the frame 8 is extended to a predetermined length, on which the bed part 20 equipped with the board-type radiant heating mattress 10 is provided.

The radiant heating mattress 10 is heated by a heating system 14. An insulator and a copper plate are set under the radiant heating mattress 10.

At this time, the heating system 14 comprises a heating wire (sheet-shaped heat generation body) heated under the control of the controller 16, a bimetal, and a temperature sensor.

Figure 4:
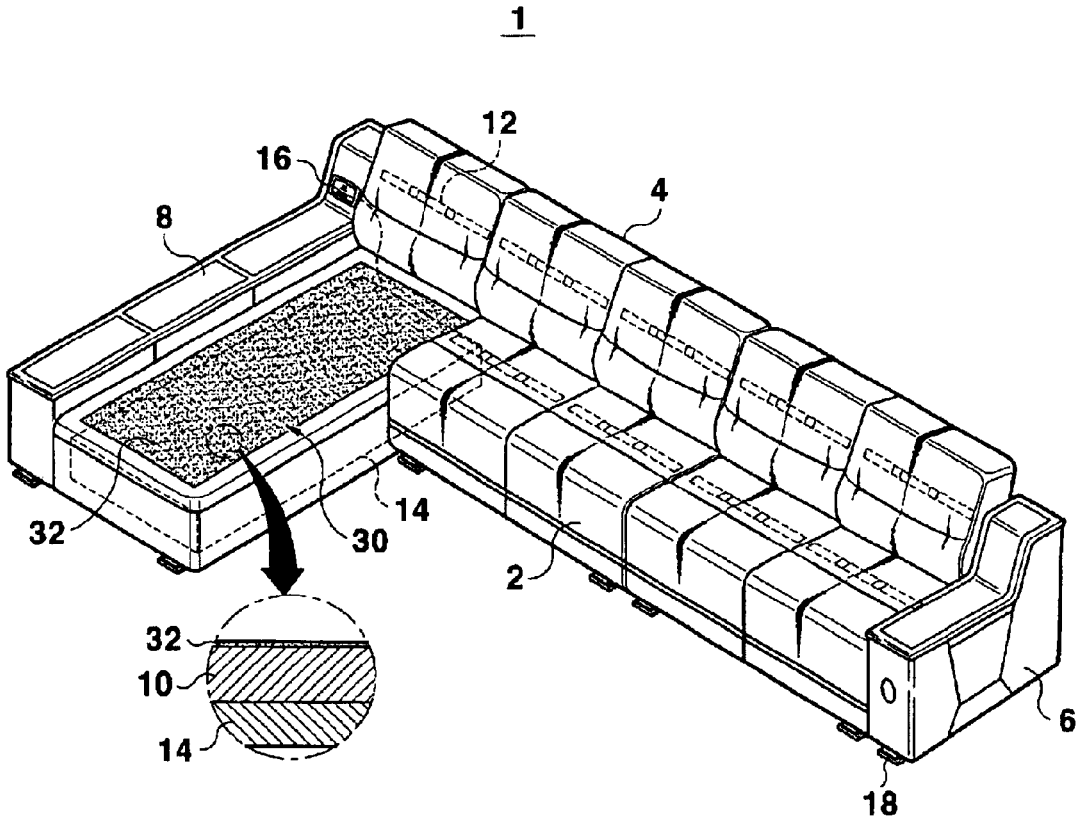
FIG. 4 is a perspective view showing a sofa according to another embodiment of the present invention.

FIG. 4 is a perspective view showing a sofa 1 according to a second embodiment of the present invention. A cushion member 32 is layered on the radiant heating mattress 10 of the bed part 20, thereby forming a cushion layer 30.

At this time, the cushion member 32 is preferably made of silicon, a smooth and soft material.

The sofa 1 according to the present invention will be used as described below.

As shown in FIGS. 1 through 3, the sofa 1 is manufactured by mounting the seat parts 2 and the back parts 4 on the frame 8. On one side of the sofa 1 is mounted the radiant heating mattress 10 instead of the seat parts 2, under which the heating system 14 formed with the heating wire heated under the control of the controller 16, a bimetal and a temperature sensor is layered.

Heating temperature of the radiant heating mattress 10 is controlled by the controller 16 installed on the frame 8, wherein the radiant heating mattress 10 and the controller 16 are connected to each other in a mode of electronic signaling so that the setting of temperature of the radiant heating mattress 10 can be controlled.

The controller 16 is commonly used in our daily lives, for which a detailed description and representation in drawings thereof are herein deleted.

In order to rest with a comfortable posture on the soft 1 finished as described above, a user sits on the seat parts 2 by putting his/her hip thereon and leaning his/her back on the back parts 4, or he/she lies on the radiant heating mattress 10 of the bed part 20.

If the user wishes to have fomentation or massage by far infrared rays while he/she is lying on the radiant heating mattress 10, he/she operates the controller 16 so as to drive the heating system 14. Then, the radiant heating mattress 10 is heated to a temperature as predetermined.

While the radiant heating mattress 10 of the bed part 20 is heated, the user takes fomentation with a comfortable posture on the radiant heating mattress 10. In this course, since the radiant heating mattress 10 is made of a board comprising jade, gold-coated board, stone, mixture of yellow earth and hardwood charcoals or ceramics, anions or far infrared rays are emitted from the radiant heating mattress 10 while the mattress 10 is heated, and thus, fomentation and/or massage by anions and far infrared rays are simultaneously performed.

The heating system 14, the insulator and the copper plate, etc are set one by one under the radiant heating mattress 10 of the bed part 20, and thus, the user can rest more conveniently and comfortably. Further, any waves or electromagnetic waves harmful to humans are completely eliminated, thereby assisting the user in recovery from fatigue, and promoting health by activating metabolism.

As described above, the sofa 1 according to the present invention serves to allow a user to rest, sitting thereon with the use of the seat parts 2 and the back parts 4. Moreover, since the user can rest with a more comfortable posture owing to the bed part 20 equipped with the radiant heating mattress that is, with being laid thereon, he/she can rest comfortably and conveniently with a comfortable posture although he/she is using the sofa 1 for a long time.

Additionally, since the sofa 1 has functions to heat itself and make massage by anions and far infrared rays, the sofa 1 does not need any separate devices for fomentation and/or massage, with multiple purposes.

The sofa 1 according to the present invention may have a variety of sizes according to uses and requirements. For example, the radiant heating mattress 10 may be installed on both sides of the sofa 1. To the radiant heating mattress 10 can be applied anions and far infrared rays good to humans, without limitation to jade, gold-coated board, stone, mixture of yellow earth and hardwood charcoals, or ceramics. In a word, any materials capable of generating heat may be applied to the radiant heating mattress 10.

As illustrated in FIG. 4, the sofa 1 according to the second embodiment of the present invention forms the cushion layer 30 by attaching the cushion member 32 to the surface of the radiant heating mattress 10, by which the user feels comfortable to the touch while parts of his/her body is in contact with the radiant heating mattress 10 to use it. Further, physical shock due to contact, especially shock applied to joints of the aged and the children is absorbed and reduced.

Any inconvenience or discomfort resulting from hard touches of the radiant heating mattress 10 while using the sofa 1 for a long time can be relieved. Contamination of the radiant heating mattress 10 due to carelessness in use, that is, by contact of different substance due to children's games, and any cracks or destruction due to hitting can be prevented by the cushion member 32. Thus, the life span of the radiant heating mattress 10 of the sofa 1 can be extended considerably.

As described above, the sofa having functions of fomentation and/or massage according to the present invention allows a user to rest more comfortably while resting with the use of the sofa, and also allows the user to take hot fomentation because the sofa is heated by a heating system Further, the sofa according to the present invention is available for massage by anions and far infrared rays emitted from jade, gold-coated board, stone, mixture of yellow earth and hardwood charcoals or ceramics, etc., thereby providing the user with more improved convenience and more promoted health as a result of the sofa.

In addition, a cushion layer may be formed on a radiant heating mattress of the sofa, thereby allowing the sofa to secure satisfaction and safety in use of the sofa to the user, preventing contamination due to external different substances or damage or destruction thereof and extending the life span of the sofa considerably.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A sofa available for fomentation and/or massage, equipped with a seat part, a back part, an arm part and a frame, comprising:

a bed part which is provided on one side of the seat part and takes a shape of a flat board having a predetermined area, with a radiant heating mattress installed on the bed part, the radiant heating mattress being produced with a board made of jade, gold-coated board, stone, mixture of yellow earth and hardwood charcoals, or ceramics, thus emitting anions and far infrared rays.

2. The sofa as claimed in claim 1, further comprising a heating system which is installed under the radiant heating mattress of the bed part.

3. The sofa as claimed in claim 1, further comprising a cushion member which is attached to the radiant heating mattress of the bed part so as to form a cushion layer.

4. The sofa as claimed in claim 2, wherein the bed part is heated by the heating system, and is controlled in a temperature thereof by a controller.

5. The sofa as claimed in claim 2, wherein the heating system comprises a heating wire, a bimetal and a temperature sensor, the heating wire being heated under the control of the controller.

* * * * *